US005238032A

United States Patent [19]

McGregor

[11] Patent Number: 5,238,032

[45] Date of Patent: Aug. 24, 1993

[54] PRODUCT SETTLER HAVING VERTICALLY MOVABLE ROLLERS

[76] Inventor: Harold R. McGregor, 216 S. Grove, Owatonna, Minn. 55060

[21] Appl. No.: 693,135

[22] Filed: Apr. 29, 1991

[51] Int. Cl.[5] ..... B65B 1/20

[52] U.S. Cl. ..... 141/80; 141/73; 141/74; 141/114

[58] Field of Search ..... 141/73, 74, 75, 76, 141/77, 78, 114, 12, 80, 195, 129, 168, 172; 198/463.3, 782, 790

[56] References Cited

U.S. PATENT DOCUMENTS

| | | | |
|---|---|---|---|
| 1,761,199 | 6/1930 | Drake | 198/782 |
| 2,767,743 | 10/1956 | Kindseth | 141/195 |
| 3,336,955 | 8/1967 | Feldman et al. | 141/73 |
| 4,093,064 | 6/1978 | Crane | 198/463. 9 |
| 4,854,353 | 8/1989 | Russell | 141/73 |
| 4,867,299 | 9/1989 | Fukuoka et al. | 198/463.3 |

*Primary Examiner*—Henry J. Recla
*Assistant Examiner*—David J. Walczak
*Attorney, Agent, or Firm*—Moore & Hansen

[57] ABSTRACT

A product settler comprising a pair of spaced-apart carriages mounted for independent reciprocal movement in a generally vertical direction relative to a surrounding frame assembly. Each carriage has a longitudinal beam generally traversing the length of the product settler and disposed on opposing sides of an intermediate zone. Extending inwardly from each beam are a plurality of rollers, each roller being mounted for rotational movement about its longitudinal axis, and extending substantially across the intermediate zone. The rollers are generally parallel to one another and preferably disposed within a horizontal plane, the rollers associated with one carriage being interspersed in a one-to-one ratio with the rollers of the opposing carriage. The carriages and rollers may be moved between completely raised and completely lowered positions at controlled rates of descent and ascent, the rollers being maintained in contact with or close proximity to the bottom of the bag and alternatingly reciprocated or oscillated to produce vibrations or discreet striking motions to settle the product within the bag. When moved to the completely lowered position, the underside of each roller contacts the top surface of one of two spaced-apart frictional drive belts moving in a closed path, contact with the drive belts thereby causing the rollers to rotate and carry the bag to a conveyor belt positioned adjacent to the downline end of the product settler. The sets of rollers may be disposed in varying staggered configurations, and be slanted across or along the intermediate zone.

29 Claims, 7 Drawing Sheets

PRODUCT SETTLER HAVING VERTICALLY MOVABLE ROLLERS

BACKGROUND OF THE INVENTION

This invention relates generally to a component of an automated bag filling machine for settling product within a bag, and particularly to a device for settling product during the filling cycle and while the bag is being lowered to the height of a conveyor belt and for transferring the bag to that conveyor.

Various devices for settling a powdered or granular product within a bag that is suspended from a fill spout in a bag filling station, or while being lowered from that fill spout to a conveyor belt, are known.

U.S. Pat. No. 4,944,334 discloses a conveyor belt assembly in which the conveyor belt beneath the bag filling station has two parallel spaced-apart tracks, and in which an oscillating or vibrating bag settling arm is disposed between the tracks and is carried vertically upward and downward along with the gab on the bag elevator assembly.

U.S. Pat. No. 2,767,743 similarly discloses a plurality of tines or arms disposed in a curved pattern beneath the bag filling station and interspersed between a plurality of V-belts similarly disposed in a curved pattern. The height of the top surface of each V-belt in the area beneath the fill station in may be independently adjusted The tines or arms move vertically along with the bag elevator assembly, and are maintained proximate to the bottom of the bag being filled with product.

However, these types of devices present some drawbacks or limitations. The bag elevator assembly must carry the mechanism for settling the product, thereby increasing the size, weight, and design complexity of the bag elevator assembly, and necessitating more powerful drive components to move the bag elevator assembly. The conveyor belts are spaced apart, requiring separate but uniformly linked drive mechanisms. A transition step occurs between transferring the bag from the bag elevator assembly to the conveyor belts, and must be timed for both the bag elevator assembly, product settling mechanism, and conveyor belts. The product settling mechanism cannot be added to existing automated bag filling machines, but must be an integral component of the bag filling machine design.

BRIEF SUMMARY OF THE INVENTION

It is therefore one object of this invention to design a product settler that may be disposed beneath the fill station of an existing automated bag filling machine and permit the product settling mechanism to travel vertically with the bag, and to simultaneously reciprocate or vibrate the product settling mechanism in contact with the bottom of the bag to settle the product within the bag.

It is another object of this invention to design the above product settler such that a single component assembly may be utilized for settling the product and for transferring the bag from the product settler to a conventional conveyor belt once the bag is filled with product.

It is an additional object of this invention to design the above product settler such that the conveyor belt may be operated continuously and without disengaging either the bag transport mechanism or drive assembly utilized to transfer the bag from the product settler to the conventional conveyor belt.

It is a further object of this invention to design the above product settler such that the product settling mechanism and associated drive assembly need not be connected to or raised and lowered by the bag elevator assembly, and further such that the drive assembly utilized to transfer the bag from the product settler to the conventional conveyor belt need not be raised and lowered.

It is yet another object of this invention to design the above product settler such that the user may control the intensity and frequency of the reciprocal movement of the bag settling mechanism as the bag is filled and lowered, the intensity and frequency of the reciprocal movement varying along a continuum between vibrational oscillations and discreet striking motions.

It is a related object of this invention to design the above product settler such that the reciprocal movement of the product settling mechanism is substantially independent of the controlled average rate of descent of the bag being lowered, the product settling mechanism oscillating predetermined distances above and below the expected vertical displacement based upon that controlled average rate of descent.

It is yet an additional object of this invention to design the above product settler such that the bag may be supported through the filling cycle by the product settling mechanism, and further that abrasion of the bag will be minimized as the bag is transferred to a downline conveyor belt.

Briefly described, the product settler of this invention comprises a pair of spaced-apart carriages mounted for independent reciprocal movement in a generally vertical direction relative to a surrounding frame assembly. Each carriage has a longitudinal beam generally traversing the length of the product settler and disposed on opposing sides of an intermediate zone. Extending inwardly from each beam are a plurality of rollers, each roller being mounted for rotational movement about its longitudinal axis, and extending substantially across the intermediate zone. The rollers are generally parallel to one another and preferably disposed within a horizontal plane, the rollers associated with one carriage being interspersed in a one-to-one ratio with the rollers of the opposing carriage. The carriages and rollers may be moved between completely raised and completely lowered positions at controlled rates of descent and ascent, the rollers being maintained in contact with or close proximity to the bottom of the bag and alternatingly reciprocated or oscillated to produce vibrations or discreet striking motions to settle the product within the bag. When moved to the completely lowered position, the underside of each roller contacts the top surface of one of two spaced-apart frictional drive belts moving in a closed path, contact with the drive belts thereby causing the rollers to rotate and carry the bag to a conveyor belt positioned adjacent to the downline end of the product settler.

DESCRIPTION OF THE PREFERRED EMBODIMENT

The product settler of this invention is shown in FIGS. 1–8 and referenced generally therein by the numeral 10.

Figure 1:
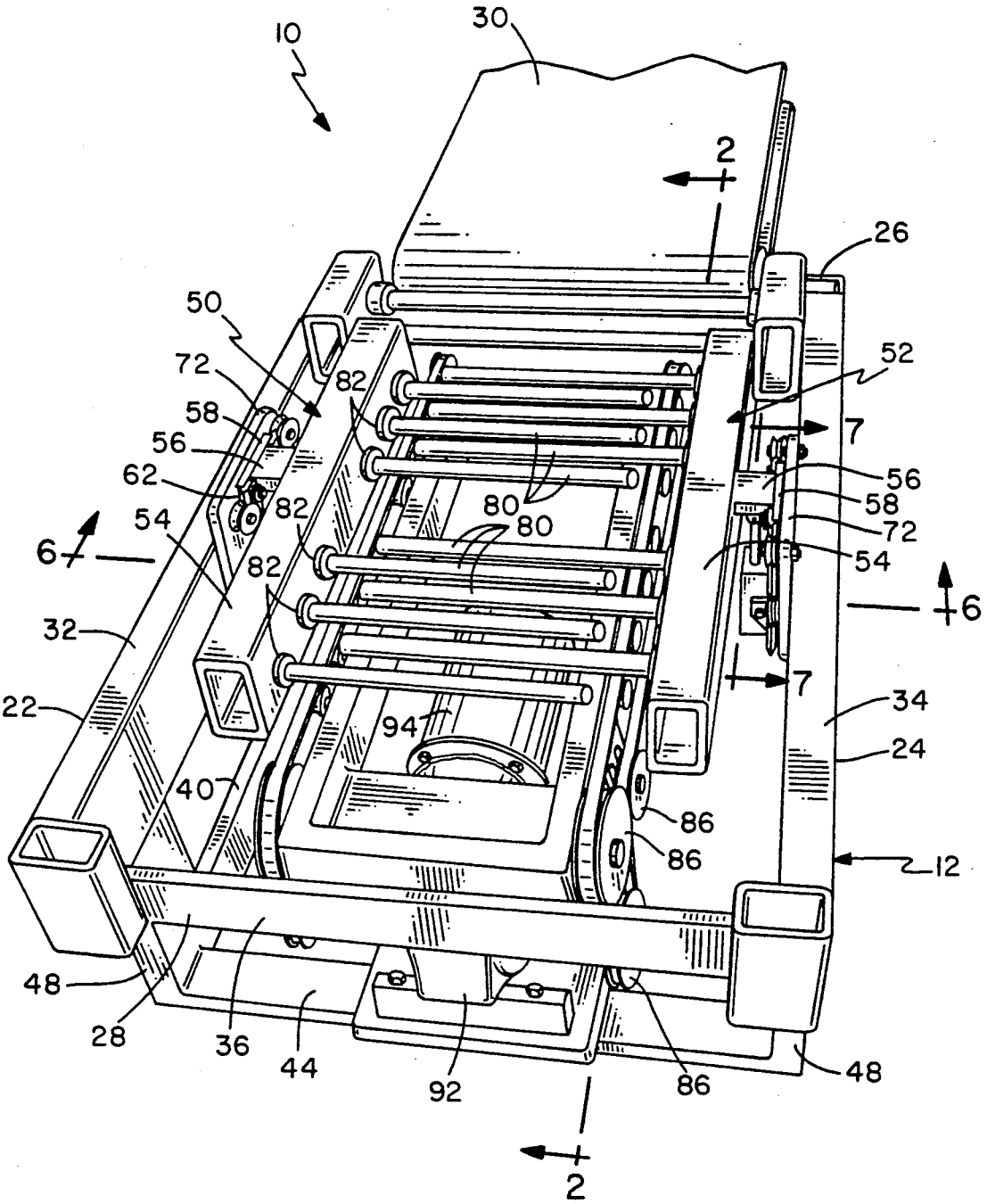
FIG. 1 is a perspective view of the product settler of this invention showing the carriages and rollers in the lowered position.
Figure 2:
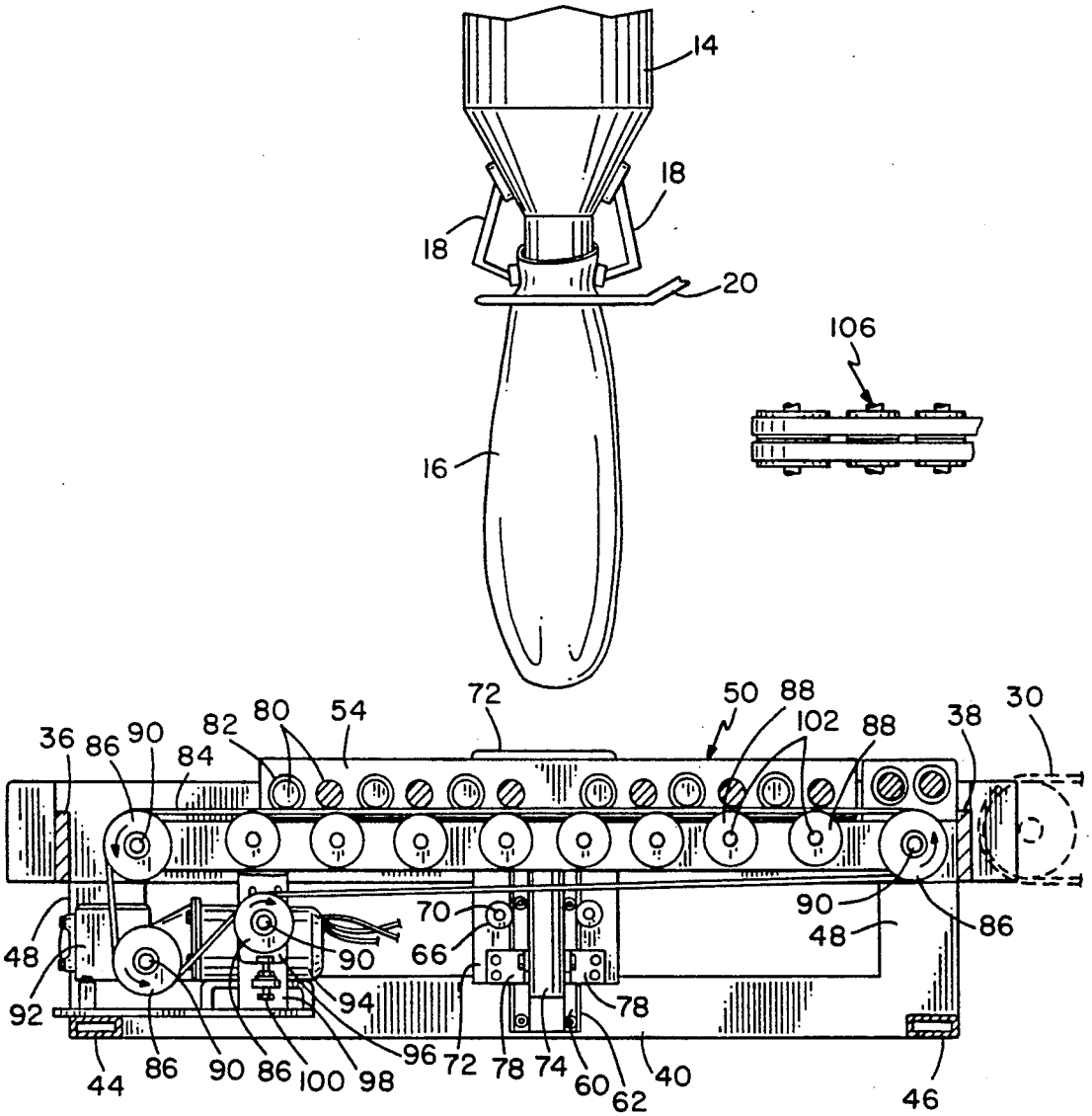
FIG. 2 is a side cross section view of the product settler of FIG. 1 taken through line 2—2 of FIG. 1 showing the carriages and rollers in the lowered position.

Referring particularly to FIGS. 1 and 2, it may be seen that the product settler 10 includes a frame assembly 12 that is positioned generally centered beneath a fill spout 14 on which a bag 16 may be suspended while the bag 16 is filled with a product. The bag 16 may be held on the fill spout 14 by a conventional bag hanging and gripping assembly 18, and may be raised to the fill spout 14 and lowered after filling by one or more bag forming or holding arms 20 or other suitable bag gripping and supporting means which are a component of and carried on a vertically moving bag elevator assembly.

The product settler 10 has a pair of opposing sides 22, 24 and a pair of opposing ends 26, 28, and is further positioned such that one of the opposing ends 26 is closely proximate to a conventional conveyor belt 30 or other bag conveying or bag transport means.

Figure 6:
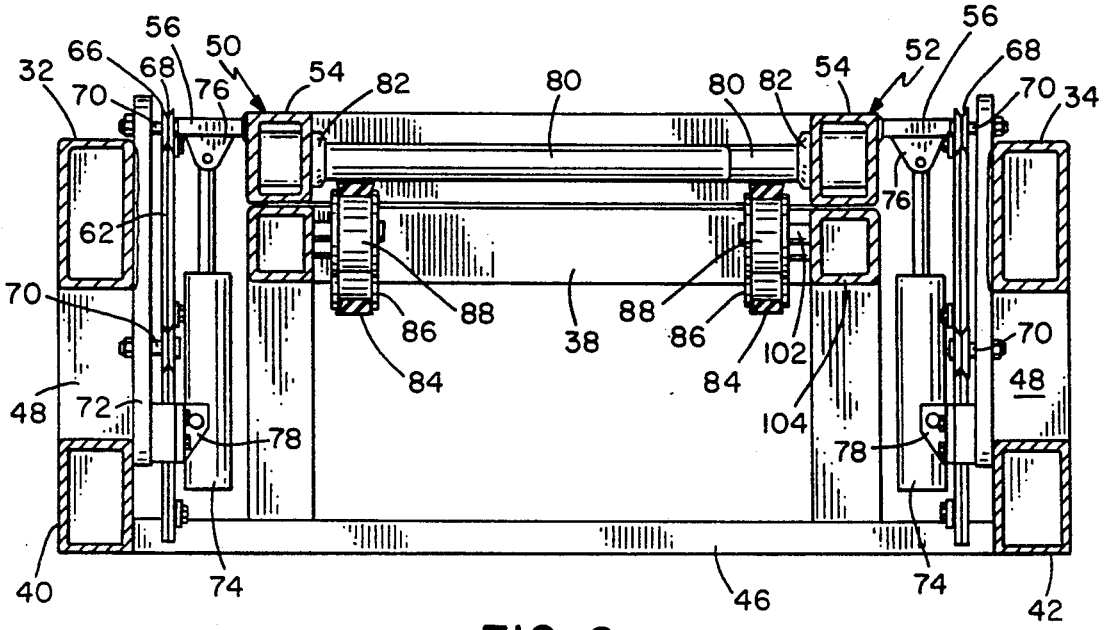
FIG. 6 is an end cross section view of the product settler of FIG. 1 taken through line 6—6 of FIG. 1 showing the carriages and rollers in the lowered position.
Figure 7:
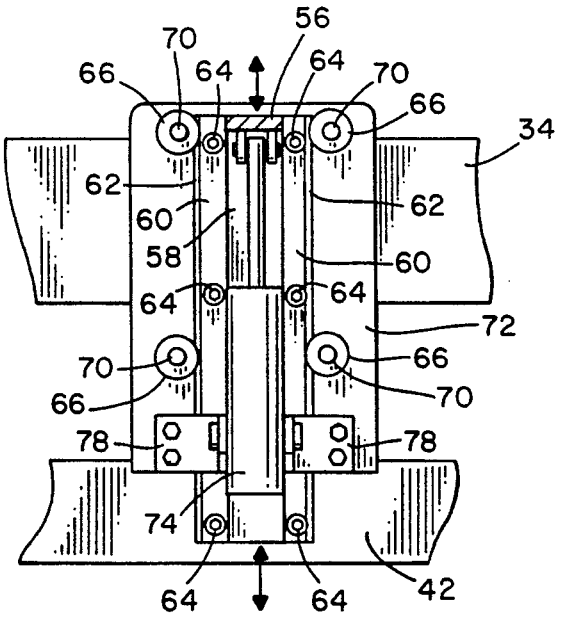
FIG. 7 is a partial side cross section view of the product settler of FIG. 1 taken through line 7—7 of FIG. 1.

Referring particularly to FIGS. 1, 2 and 6, the frame assembly 12 of the product settler 10 includes a pair of opposing upper side frame members 32, 34 a pair of upper end frame members 36, 38 fixedly connected to form a generally rectangular upper frame section, a pair of opposing lower side frame members 40, 42 and a pair of lower end frame members 44, 46 fixedly connected to form a generally rectangular lower frame section, and four generally upright frame members 48 fixedly connected to and extending between the generally rectangular upper and lower frame sections.

Referring particularly to FIGS. 1, 2, 6 and 7, is may be seen that a pair of carriages 50, 52 are positioned on opposing sides of the product settler 10 and extend along and generally parallel with the upper side frame members 32, 34. Each carriage 50, 52 includes a longitudinal beam 54 of generally hollow tubular construction and having an inner surface and an outer surface. Fixedly connected to and extending outwardly from the outer surface of the longitudinal beam 54 is a spacer bracket 56, the outer end of the spacer bracket 56 in turn being fixedly connected to the top end of a track plate 58. An edge strip 60 is removably and adjustably connected to and extends along each opposing vertical side edge of the track plate 58, each edge strip 60 having a beveled outer edge 62 and being fastened to the track plate 58 using a plurality of threaded fasteners 64 or other conventional fastening means.

The track plate 58 is maintained in a generally vertical orientation and movably carried on a plurality of guide wheels 66, the guide wheels 66 being disposed in two vertically aligned and spaced-apart columns with the edge strips 60 of the track plate 58 being engagingly received within the vee-slots 68 of the guide wheels 66. Each guide wheel 66 is rotatably mounted on an axle 70 fixedly connected to a backing plate 72 using a conventional fastening means, with the guide wheels 66 being spaced apart a distance from the backing plate 72 by the axles 70. The backing plate 72 is in turn fixedly connected to and extends between the corresponding upper and lower side frame members 32, 40 or 34, 42, respectively.

Each carriage 50, 52 may be raised and lowered by a dual acting power cylinder 74 which is connected at one end to a mounting flange 76 attached to and depending from the spacer bracket 56, and connected at the opposing end to a pair of mounting brackets 78 in turn connected to the backing plate 72 or frame assembly 12.

Extending inwardly from each inner surface of the longitudinal beams 54 are a plurality of rollers 80, each roller 80 having a generally cylindrical or bar shape. Each roller 80 traverses or extends substantially across the intermediate zone between the longitudinal beams 54, and terminates short of the longitudinal beam 54 opposing the longitudinal beam 54 to which the corresponding roller 80 is connected. Each roller 80 is rotatably connected to and mounted on the corresponding longitudinal beam 54 using a conventional bearing collar assembly 82. The rollers 80 associated with each longitudinal beam 54 are generally parallel to one another and are spaced apart along and within a generally horizontal plane, the rollers 80 associated with one longitudinal beam 54 being interspersed or alternatingly staggered in a one-to-one ratio with the rollers 80 of the opposing or facing longitudinal beam 54. The rollers 80 are preferably further disposed in two groups, each group being disposed more closely adjacent to one of the opposing ends 26, 28 of the product settler 10 with a central area being generally open, although the rollers 80 may be disposed or dispersed evenly or continuously along the length or a portion of the length of the longitudinal beams 54 or intermediate zone.

As may be seen in FIG. 2, the carriages 50, 52 may be initially disposed in a lowered position whereat the top tangential surfaces of each roller 80 lie generally along and define a generally horizontal plane disposed at a height substantially equal to the height of the top surface of the conventional conveyor belt 30 adjacent to which the product settler 10 is disposed.

Figure 3:
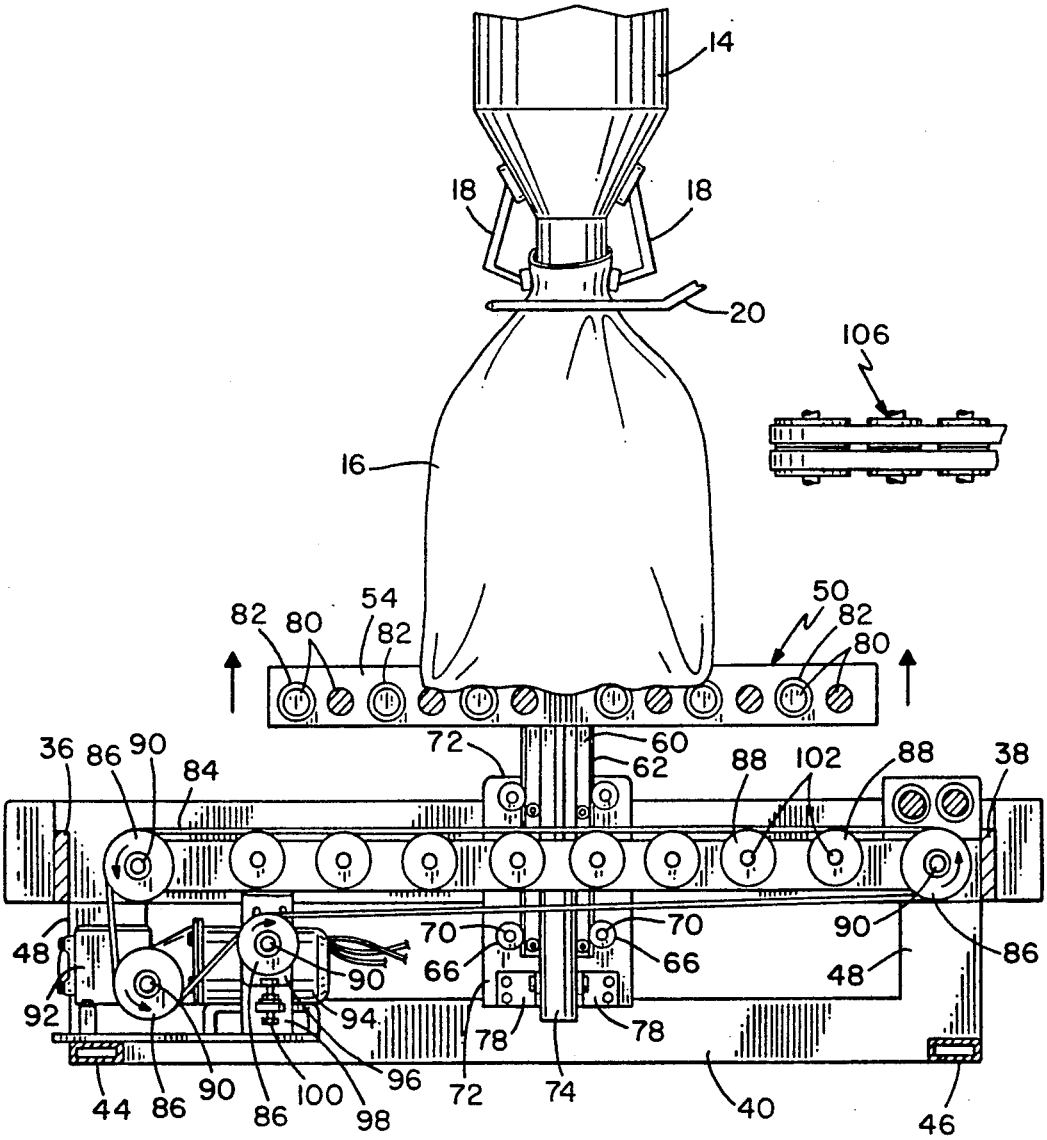
FIG. 3 is a side cross section view of the product settler of FIG. 1 taken through line 2—2 of FIG. 1 showing the carriages and rollers being raised in unison to the raised position.

Once a bag 16 is hung on the fill spout 14 and filled with product, or during the bag hanging and filling cycle, the carriages 50, 52 may be selectively or responsively raised in a generally vertical direction by the dual acting power cylinders 74 to a raised position disposed closely proximate to and contacting the bottom of the bag 16 as shown in FIG. 3.

Figure 4:
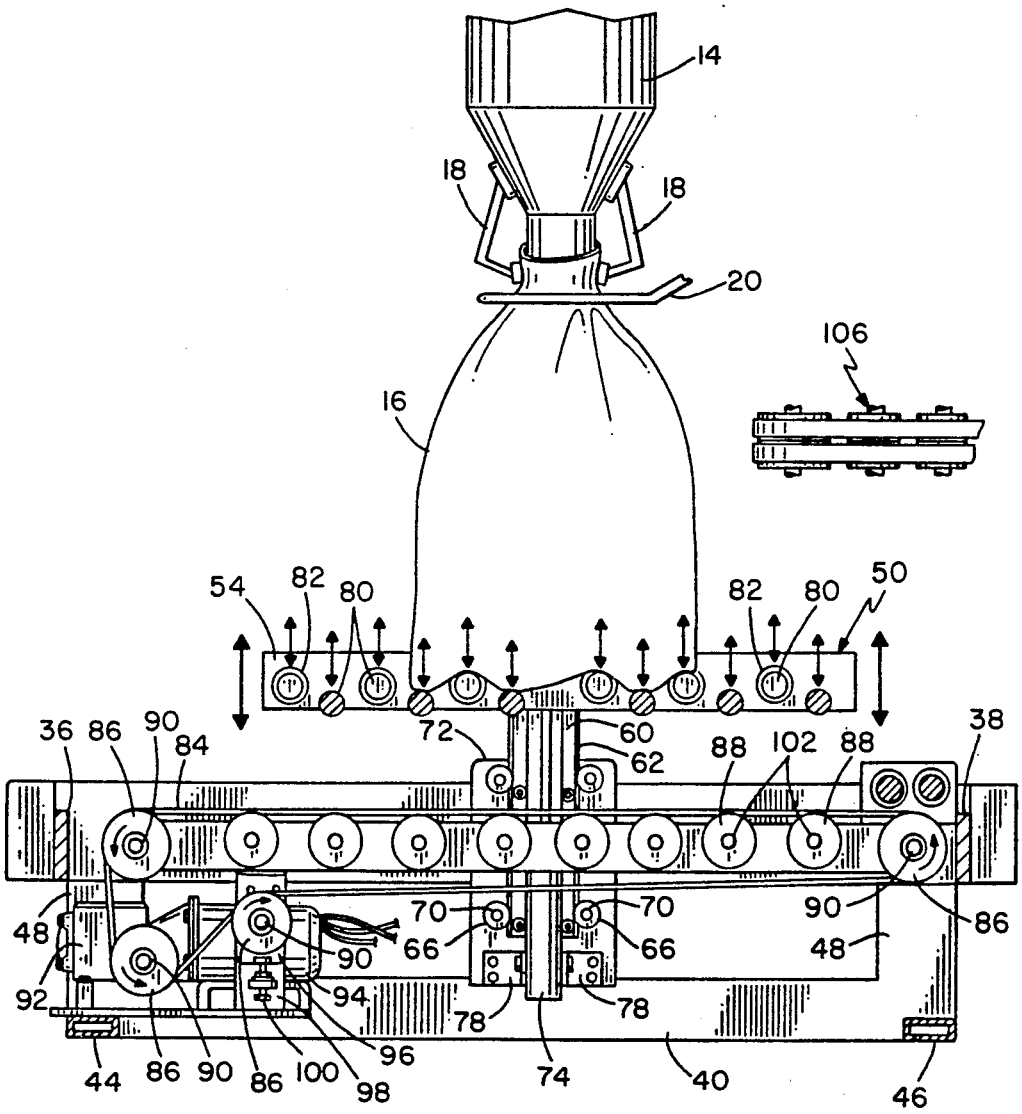
FIG. 4 is a side cross section view of the product settler of FIG. 1 taken through line 2—2 of FIG. 1 showing the carriages and rollers being reciprocated in opposition while being raised to the raised position or lowered to the lowered position generally in unison.

The dual acting power cylinders 74 may then be selectively or responsively actuated and deactuated to cause the carriages 50, 52 and rollers 80 to alternatingly reciprocate in a generally vertical direction and strike the bottom of the bag 16 as shown in FIG. 4, or alternately actuated and deactuated in unison to cause the rollers 80 of the opposing carriages 50, 52 to strike the bag 16 in unison.

Figure 5:
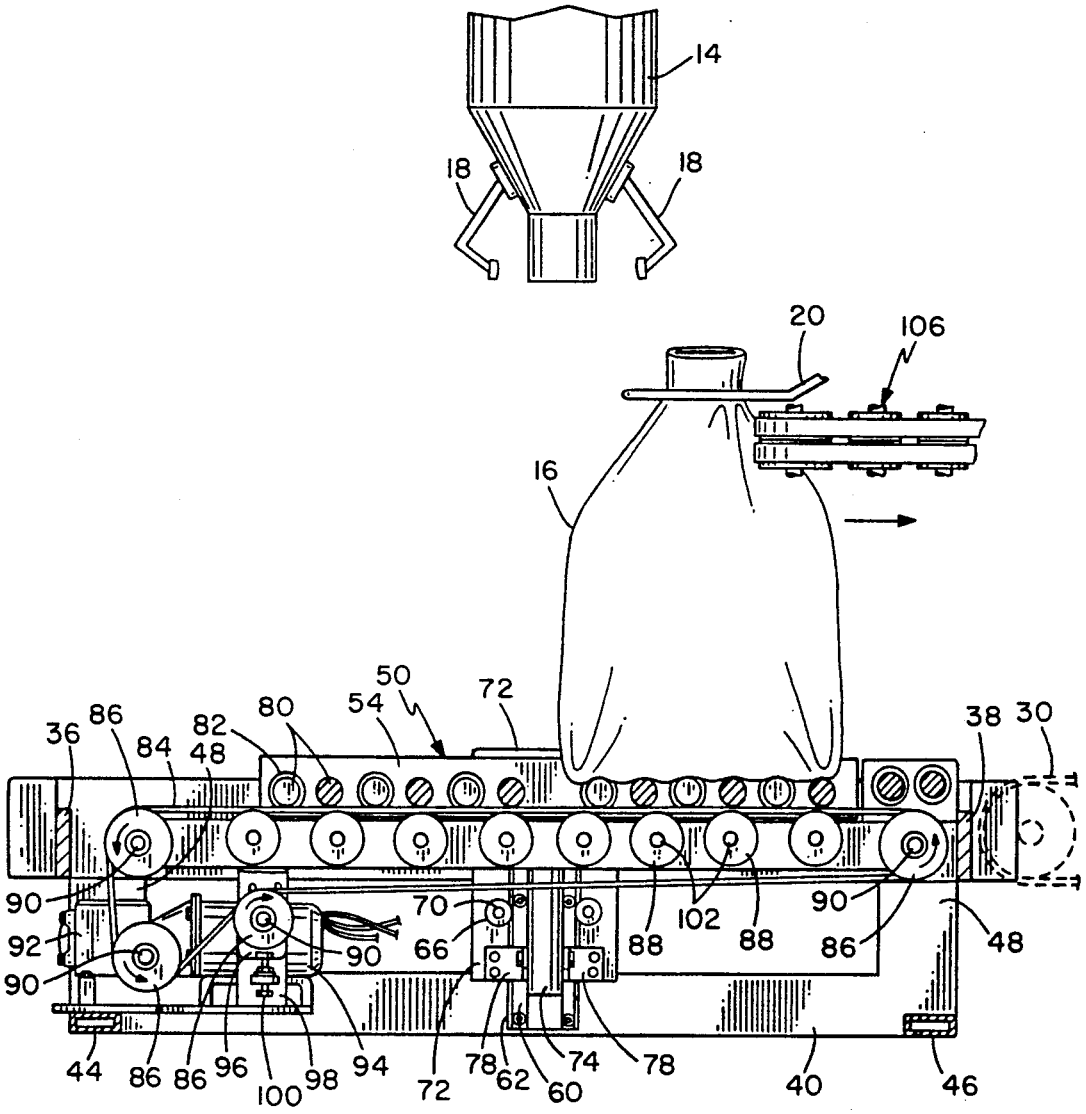
FIG. 5 is a side cross section view of the product settler of FIG. 1 taken through line 2—2 of FIG. 1 showing the carriages and rollers lowered to the lowered position and rotated to transfer the bag to the conveyor assembly.

As the bag 16 is lowered from the fill spout 14 to a height approximately equal to the top surface of the conventional conveyor belt 30, the dual acting power cylinders 74 may continue to cause the carriages 50, 52 and rollers 80 to alternatingly reciprocate in the vertical direction striking or vibrating the bag 16 and product therein, while the carriages 50, 52 and rollers 80 move to the completely lowered position as shown in FIG. 5. Consequently, the carriages 50, 52 and rollers 80 move from the raised position to the lowered position at a controlled average rate of descent, with the reciprocal movement of each set of carriages 50, 52 and rollers 80 moving or oscillating predetermined distances above and below the expected or predicted average vertical displacement based upon that controlled average rate of descent for the combined carriages 50, 52 and rollers 80 during each movement or stroke of the carriages 50, 52 and rollers 80. As such, the controlled average rate of descent need not be a linear function, and in most cases will have at least an acceleration phase and a deceleration phase, but will be determined to some extent by the distance between the completely raised and completely lowered positions and the time interval in which the bag 16 must move between those positions. The reciprocation distance which each carriage 50, 52 and roller 80 moves or is displaced above and below the predicted displacement based upon the controlled average rate of descent during each upward or downward stroke of that carriage 50, 52 and roller 80 will be determined by the shape or slope of the curve for the controlled average rate of descent and the amount or magnitude of vibration that is to be imparted to the bag 16, depending upon the particular variables affecting the settling or de-aeration of the product within the bag 16 for a given product and bag 16. The controlled average rate and the reciprocation distances may be determined and adjusted either manually or selectively, in responsive to input signals from conventional position or motion sensors, or according to a predetermined program.

Figure 8A:
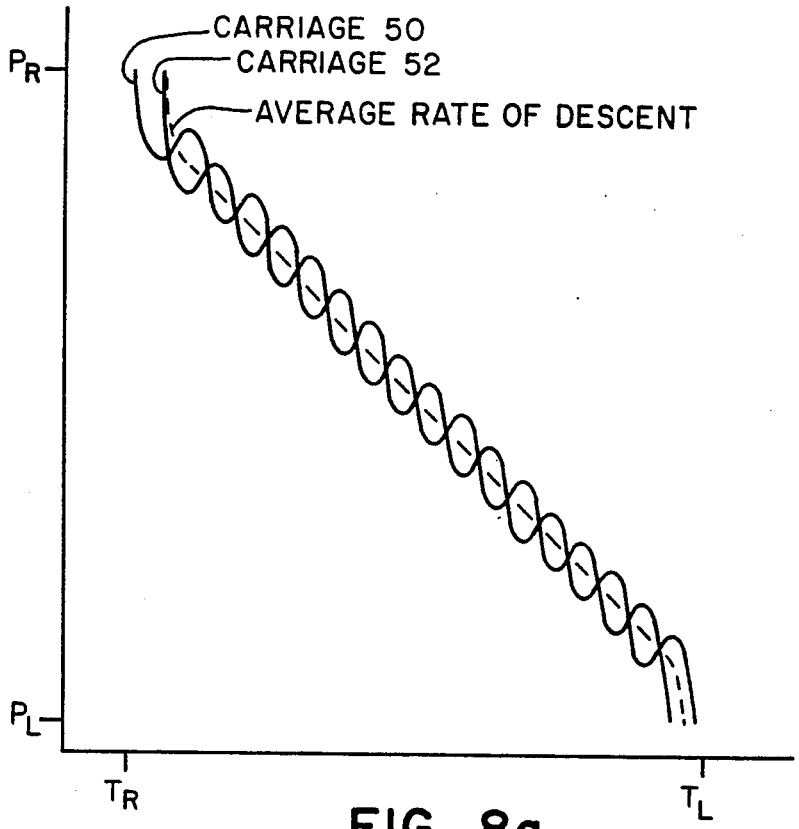
FIG. 8*a* is a displacement diagram showing one possible course along which the carriages and rollers move between the completely raised and completely lowered positions.

FIG. 8*a* shows diagrammatically one possible course for the carriages 50, 52 and the rollers 80 associated with each carriage 50, 52. In FIG. 8*a*, the vertical axis is the relative height or displacement of a similar point on each carriage 50, 52 or roller 80 (or a generally horizontal plane defined by the top surfaces of the rollers 80 associated with one carriage 50, 52) compared with a fixed reference point such as the frame assembly 12, the floor, or the fill spout 14. The horizontal axis shows time between two points within the bag filling and settling cycle, such as the time TR where the carriages 50, 52 are momentarily at rest in the completely raised position, and TL where the carriages 50, 52 are momentarily at rest in the completely lowered position.

In FIG. 8*a*, each carriage 50, 52 initially starts in the completely raised position PR, with one carriage 50 descending, followed by the opposing carriage 52. The bag 16 will thus rest upon or be contacted by the rollers 80 associated with the uppermost carriage 52 which lags behind the first carriage 50 to move. The descent of the first carriage 50 to move will stop, and that carriage 50 will begin to ascend toward the opposing carriage 52 which is descending, until the carriages 50, 52 are momentarily disposed at the same height with the top surfaces of the rollers 80 aligned along a common horizontal plane. At that junction point, the bag 16 will be contacted or supported equally by each of the carriages 50, 52. The second carriage 52 will continue to descend, while the first carriage 50 continues to ascend, thereby transferring the bag 16 to the rollers 80 associated with the first carriage 50 and imparting an upward strike or force to the bottom of the bag 16 and product causing the product to vibrate, move, or settle within the bag 16. This process is repeated alternately by each carriage 50, 52 and the associated rollers 80 until the carriages 50, 52, rollers 80, and bag 16 is disposed in the completely lowered position PL.

Figure 8B:
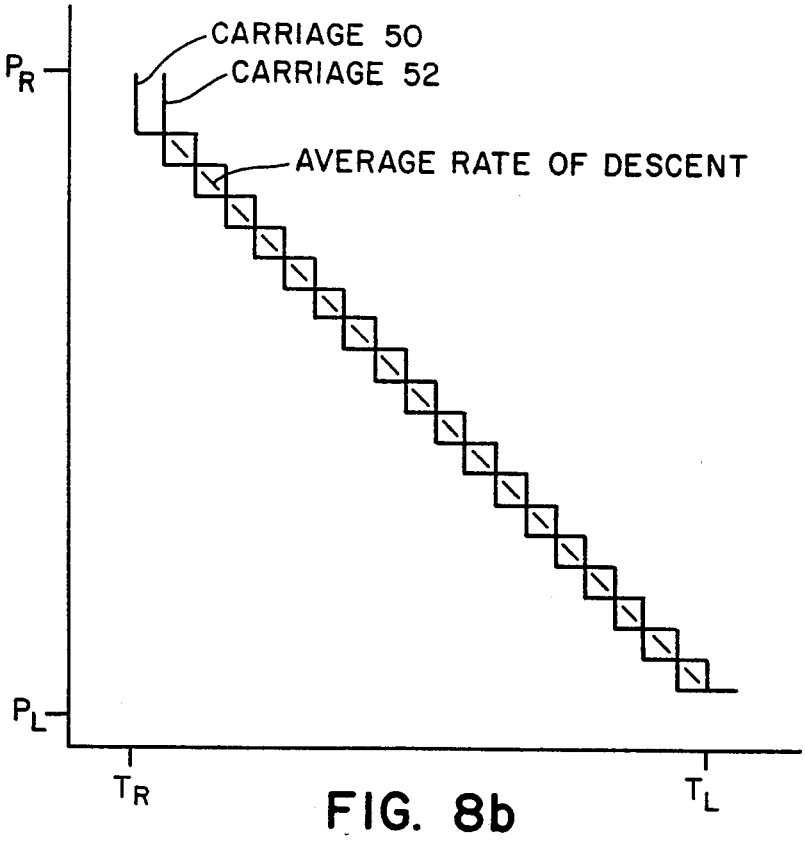
FIG. 8*b* is a displacement diagram showing an alternate course along which the carriages and rollers move between the completely raised and completely lowered positions.

By comparison, in FIG. 8*b* the carriages 50, 52 do not ascend. In FIG. 8*b*, each carriage 50, 52 initially starts in the completely raised position PR, with one carriage 50 descending, followed by the opposing carriage 52. The bag 16 will thus rest upon or be contacted by the rollers 80 associated with the uppermost carriage 52 which lags behind the first carriage 50 to move. The descent of the first carriage 50 to move will stop, and that carriage 50 will rest beneath the opposing carriage 52 which is descending, until the carriages 50, 52 are momentarily disposed at the same height with the top surfaces of the rollers 80 aligned along a common horizontal plane. At that junction point, the bag 16 will be contacted or supported equally by each of the carriages 50, 52. The second carriage 52 will continue to descend, while the first carriage 50 stays at rest, thereby transferring the bag 16 to the rollers 80 associated with the first carriage 50 and imparting a force on the bottom of the bag 16 similar to controllably dropping the bag 16 a short distance on to a hard surface, causing the product to vibrate, move, or settle within the bag 16. This process is repeated alternately by each carriage 50, 52 and the associated rollers 80 until the carriages 50, 52, rollers 80, and bag 16 is disposed in the completely lowered position PL.

It is understood that the displacement diagrams shown in FIGS. 8*a* and 8*b* are merely two representative examples of the most likely displacement courses for the rollers 80, and that a virtually unlimited selection of descent paths, reciprocation distances, controlled average rates of descent, and the like may be selected for particular applications. The number and magnitude of the reciprocations per each cycle may be adjusted independently, with many small vibrations or only a few forceful strikes being delivered to the bag 16 and product as desired. The bag 16 and product need not necessarily always contact or be supported in whole or in part by the rollers 80, but the bag 16 may be lowered completely by the bag elevator assembly 20 with the rollers 80 normally preceding the bottom of the bag 16 and only contacting the bag 16 at the uppermost points along their ascending displacement.

The top surfaces of the rollers 80 need not define a common horizontal plane, nor does any plane defined by the rollers 80 need to be oriented horizontally. For example, the rollers 80 associated with opposing carriages 50, 52 might be sloped or angled downwardly toward one another in the intermediate zone, or may be disposed along a sloped or angled line toward the front or rear of the product settler 10, or both, such that the bag 16 and product are additionally jarred forward, backward, or from side to side as the carriages 50, 52 and rollers 80 reciprocate. In such a configuration, each set of rollers 80 might define or at least lie within a common plane, but the planes defined by each set of rollers 80 might be non-parallel, and might further be angled relative to one another along two separate axis forming one or more troughs disposed and oriented along the lateral (widthwise) or longitudinal (lengthwise) axes of the product settler 10.

Referring again particularly to FIGS. 1, 5, and 6, it may be seen that the product settler 10 may additionally operate to transport the bag 16 to the conventional conveyor belt 30 or other bag conveying or bag transport means.

When the carriages 50, 52 are lowered to the completely lowered position, the bottom or underside surfaces of each of the rollers 80 contacts one of two frictional drive belts 84 disposed on each side of the intermediate zone of the product settler 10 and extending longitudinally along the length thereof. Each frictional drive belt 84 comprises and endless loop which is carried over a circuitous path on a plurality of guide wheels 86, and which is supported at least in the intermediate zone by a plurality of rotatably mounted support wheels 88. The support wheels 88 are each disposed laterally adjacent to the carriages 50, 52 and in longitudinal spaced-apart relation adjacent to an associated one or between a pair of the rollers 80, with the rollers 80 similarly in longitudinal spaced-apart relation adjacent to an associated one or between a pair of the support wheels 88.

The guide wheels 86 are each carried and connected to one of a plurality of axles 90 rotatably mounted on the frame assembly 12, with one axle being operatively connected to an axle-mounted differential 92 or similar transmission device or drive chain, which is in turn operatively connected to a drive motor 94. The drive motor 94 rotates the corresponding axle 90 through operation of the differential 92 or drive chain, thus rotating two of the guide wheels 86 attached to that axle 90 in the same direction. The frictional drive belts 84 are thus moved along closed loops, such that the portion of the frictional drive belts 84 disposed above the support wheels 88 each traverse the length of the product settler 80 in the same direction as one another and toward the rear end 26 of the product settler 10 and the conventional conveyor belt 30.

The frictional drive belts 84 each form a bend at a point disposed beneath the rollers 80 and adjacent the drive motor 94, with the guide wheel 86 at that point being mounted on a movable plate 96 slidably connected to and carried on a generally vertical track 98. The tension on the frictional drive belts 84 may be independently and selectively adjusted by moving the movable plate 96 and guide wheel 86 linearly along the generally vertical track 98 using a threaded adjustment mechanism 100, thereby tightening or loosening the pressure applied by the guide wheel 86 on the corresponding frictional drive belt 84.

Each support wheel 88 is rotatably mounted on an axle 102 which is connected to an intermediate frame member 104 extending longitudinally along one of the sides of the intermediate zone of the product settler 10.

As each carriage 50, 52 and the associated rollers 80 are lowered to the completely lowered position and into contact with the frictional drive belts 84, the longitudinal movement of the frictional drive belts 84 will cause each of the rollers 80 to rotate relative to the carriages 50, 52, with the top tangential surfaces of each roller 80 moving in a direction toward the rear end 26 of the product settler 10 and the conventional conveyor belt 30. As the weight of the bag 16 and product is rested on the top surfaces of the rollers 80, the bag 16 and product will be carried toward the conventional conveyor belt 30 by the rollers 80. The top of the bag 16 may additionally be gripped and carried by a top belt assembly 106 or similar device capable of maintaining the bag 16 in an upright position as the bag 16 is transported to a topping, weighing, sealing, or other processing station (not shown).

The top surface of the conventional conveyor belt 30 can therefore be maintained rotating or moving at a constant linear speed, and the bag 16 and product can be accelerated along the rollers 80 to a maximum speed adjusted to match the speed of conveyor belt 30 when the bag 16 is transferred to the conveyor belt 30. The frictional drive belts 84 may be stopped during the filling cycle, but it is anticipated that in most applications the frictional drive belts 84 will remain moving at a constant speed and the rollers 80 will immediately rotate upon contacting the frictional drive belts 84. In some applications, it may be desired to equip the rollers 80 with a method of braking or damping the rotation of those rollers 80 when initially lifted away from the frictional drive belts 84.

The rollers 80 as shown in FIG. 1 each contact a single frictional drive belt 84 closely adjacent to the proximal end thereof, but each roller 80 may alternately extend completely across the intermediate zone of the product settler 10 and contact both of the frictional drive belts 84 when the associated carriage 50, 52 is in the completely lowered position.

While the preferred embodiment of the above product settler 10 has been described in detail with reference to the attached drawing Figures, it is understood that various changes and adaptations may be made in the product settler 10 without departing from the spirit and scope of the appended claims.

What is claimed is:

1. A product settler for settling a product within a bag, said bag having a bottom, said bag being carried on a bag elevator assembly or the like mounted for generally vertical movement between a raised position and a lowered position, said product settler comprising:

a frame assembly;

at least one carriage, said carriage being connected to said frame and mounted for movement in a general vertical direction;

a plurality of rollers, each of said plurality of rollers being connected to said carriage for reciprocal movement therewith in said generally vertical direction and mounted for rotation about an axis of rotation, at least a portion of each of said plurality of rollers being disposed generally beneath the bag when the bag is carried out on the bag elevator assembly or the like;

means for selectively moving said carriage and said plurality of rollers connected thereto between a completely raised position and a completely lowered position, said means for moving said carriage being capable of maintaining said plurality of rollers in close proximity to the bottom of the bag while the bag is moved from the raised position to the lowered position, said plurality of rollers moving between said completely raised position and said completely lowered position along a path corresponding to an average rate of descent of the bag being moved from the raised position to the lowered position, said plurality of rollers being reciprocated in a generally vertical direction such that said plurality of rollers oscillate a predetermined distance above or below said path; and means for selectively rotating each of said plurality of rollers when said carriage is moved to said completely lowered position.

2. The product settler of claim 1 wherein the number of carriages is two and includes a first carriage and a second carriage.

3. The product settler of claim 2 wherein the product settler has a pair of opposing sides and wherein the first carriage and the second carriage are each disposed proximate to a one of said pair of opposing sides of the product settler.

4. The product settler of claim 3 wherein each of the first carriage and the second carriage includes a longitudinal beam, each said longitudinal beam extending along and generally parallel with one of the pair of opposing sides of the product settler and generally parallel with one another.

5. The product settler of claim 3 where the plurality of rollers are divided into a first group and a second group, said first group of the plurality of rollers being connected to and extending inwardly from the first carriage, said second group of the plurality of rollers being connected to and extending inwardly from the second carriage.

6. The product settler of claim 5 wherein the first carriage and the second carriage defines an intermediate zone therebetween, the first group of the plurality of rollers extending from the first carriage substantially across said intermediate zone toward the second carriage and terminating within said intermediate zone, the second group of the plurality of rollers extending from the second carriage substantially across said intermediate zone toward the first carriage and terminating within said intermediate zone.

7. The product settler of claim 5 wherein each of the rollers in the first group of the plurality of rollers is disposed in an interspersed relationship to the rollers of the second group of the plurality of rollers.

8. The product settler of claim 5 wherein each of the rollers in the first group of the plurality of rollers are alternatingly staggered in a one-to-one ratio with each of the rollers of the second group of the plurality of rollers.

9. The product settler of claim 5 wherein the rollers of the first group of the plurality of rollers and the second group of the plurality of rollers are divided into a first set and a second set, said first set being spaced apart from said second set.

10. The product settler of claim 9 wherein the product settler has a front end and a rear end, the first set being disposed more closely proximate to said front end and the second set being disposed more closely proximate to said rear end.

11. The product settler of claim 5 wherein the number of the rollers in the first group of the plurality of rollers is six and the number of the rollers in the second group of the plurality of rollers is six.

12. The product settler of claim 2 wherein the first carriage and the second carriage may be moved from the completely lowered position to the completely raised position in unison with one another.

13. The product settler of claim 2 wherein the first carriage and the second carriage may be moved from the completely raised position to the completely lowered position independent of one another.

14. The product settler of claim 2 wherein the first carriage and the second carriage may be reciprocated independent of one another such that the first carriage may move upwardly as the second carriage moves downwardly, and further such that the first carriage may move downwardly as the second carriage moves upwardly.

15. The product settler of claim 1 wherein the carriage moves along a track attached to the frame assembly, and wherein the means for moving the carriage and the plurality of rollers between the completely raised position and the completely lowered position includes a dual acting power cylinder, said dual acting power cylinder being connected to the frame assembly and to the carriage.

16. The product settler of claim 1 wherein the means for rotating each of the plurality of rollers when the carriage is moved to the completely lowered position includes at least one drive belt, said drive belt traversing a circuitous path and having a top surface disposed beneath and generally parallel with the plurality of rollers when the carriage is moved to the completely lowered position, at least a portion of each of the plurality of rollers contacting and frictionally engaging said top surface of said drive belt when the carriage is moved to the completely lowered position.

17. The product settler of claim 16 wherein the drive belt is carried on a plurality of guide wheels.

18. The product settler of claim 16 wherein each of the plurality of rollers are spaced apart longitudinally from one another, and wherein the drive belt is supported in at least the intermediate zone by a plurality of support wheels when the carriage is moved to the completely lowered position, each of said plurality of support wheels being mounted for rotation with each of the plurality of rollers being disposed in longitudinal spaced-apart relation adjacent to and between an associated pair of the plurality of support wheels.

19. The product settler of claim 16 wherein the number of drive belts is two.

20. The product settler of claim 1 wherein each of the plurality of rollers has a generally cylindrical shape.

21. The product settler of claim 1 wherein each of the plurality of rollers are generally disposed within a common plane when the carriage is moved to the completely lowered position.

22. The product settler of claim 21 wherein the common plane is oriented in a generally horizontal orientation when the carriage is moved to the completely lowered position.

23. The product settler of claim 21 wherein the bag is transferred from the rollers to the top of a conveyor belt when the rollers are rotated, said top of said conveyor belt being disposed at a predetermined height, and wherein each of the plurality of rollers has a top surface and the common plane is defined by said top surfaces of the plurality of rollers and disposed at a height generally equal to and aligned with said predetermined height of said top surface of said conveyor belt.

24. A product settler for settling a product within a bag, said bag having a bottom, said bag carried on a bag elevator assembly or the like mounted for generally vertical movement between a raised position and a lowered position, said product settler comprising:

a frame assembly;

a first carriage, said first carriage being connected to said frame and mounted for reciprocal movement in a generally vertical direction;

a second carriage, said second carriage being connected to said frame and mounted for reciprocal movement in a generally vertical direction independent of said reciprocal movement in said generally vertical direction of said first carriage;

a plurality of rollers, at least a portion of each of said plurality of rollers being disposed generally beneath the bag when the bag is carried on the bag elevator assembly or the like, said plurality of rollers being divided into a first group and a second group, said first group of said plurality of rollers each being connected to said first carriage for reciprocal movement therewith in said generally vertical direction, said second group of said plurality of rollers each being connected to said second carriage for reciprocal movement therewith in said generally vertical direction, each of said plurality in said first group being spaced apart and disposed in an interspersed relationship with said plurality of rollers in said second group;

means for selectively moving said first carriage and said first group of said plurality of rollers connected thereto between a completely raised position and a completely lowered position, said means for moving said first carriage being capable of maintaining said first group of said plurality of rollers in close proximity to the bottom of the bag while the bag is moved from the raised position to the lowered position; and means for selectively moving said second carriage and said second group of said plurality of rollers connected thereto between a completely raised position and a completely lowered position, said means for moving said second carriage being capable of maintaining said second group of said plurality of rollers in close proximity to the bottom of the bag while the bag is moved from the raised position.

25. The product settler of claim 24 wherein each of the rollers in the first group of the plurality of rollers are alternatingly staggered in a one-to-one ratio with each of the rollers in the second group of the plurality of rollers.

26. The product settler of claim 24 wherein the first carriage and the second carriage may be moved from the completely lowered position to the completely raised position in unison with one another, and wherein the first carriage and the second carriage may be moved from the completely raised position to the completely lowered position independent of one another.

27. The product settler of claim 24 wherein each of the plurality of rollers is mounted for rotation about an axis of rotation, the product settler further comprising:

means for selectively rotating each of the first group of the plurality of rollers when the first carriage is moved to the completely lowered position; and means for selectively rotating each of the second group of the plurality of rollers when the second carriage is moved to the completely lowered position.

28. The product settler of claim 24 wherein the first carriage and the second carriage may be reciprocated independent of one another such that the first carriage may move upwardly as the second carriage moves downwardly, and further such that the first carriage may move downwardly as the second carriage moves upwardly.

29. The product settler of claim 24 wherein the first carriage and the second carriage each move between the completely raised position and the completely lowered position along a path corresponding to an average rate of descent, and further wherein the first carriage and the second carriage may each be reciprocated in a generally vertical direction such that the first group of the plurality of rollers associated with the first carriage and the second group of the plurality of rollers associated with the second carriage are selectively oscillated a predetermined distance above or below said path.

* * * * *